US008844744B2

(12) United States Patent
Lucas

(10) Patent No.: US 8,844,744 B2
(45) Date of Patent: Sep. 30, 2014

(54) PACKAGING PROVIDED WITH A SEALED OPENING AND CLOSING DEVICE

(75) Inventor: Franck Lucas, Gergy (FR)

(73) Assignee: 3L Distribution Industrie, Champforgeuil (FR)

( * ) Notice: Subject to any disclaimer, the term of this patent is extended or adjusted under 35 U.S.C. 154(b) by 0 days.

(21) Appl. No.: 13/978,855

(22) PCT Filed: Jan. 5, 2012

(86) PCT No.: PCT/FR2012/050036
§ 371 (c)(1),
(2), (4) Date: Aug. 23, 2013

(87) PCT Pub. No.: WO2012/095593
PCT Pub. Date: Jul. 19, 2012

(65) Prior Publication Data

US 2013/0320012 A1 Dec. 5, 2013

(30) Foreign Application Priority Data

Jan. 10, 2011 (FR) ..... 11 50150

(51) Int. Cl.
*B65D 51/18* (2006.01)
*B65D 17/50* (2006.01)
*B65D 43/26* (2006.01)

(52) U.S. Cl.
CPC ..... *B65D 43/265* (2013.01); *B65D 17/506* (2013.01)
USPC ..... 220/254.3; 220/254.7; 220/266; 220/259.1; 220/255.1; 220/258.3; 206/217; 215/250

(58) Field of Classification Search
USPC ..... 220/254.3, 254.1, 254.7, 254.9, 260, 220/265, 266, 259.1, 255.1, 258.3; 215/228, 250; 206/217
See application file for complete search history.

(56) References Cited

U.S. PATENT DOCUMENTS

| | | | | |
|---|---|---|---|---|
| 7,918,359 | B2 * | 4/2011 | Paris et al. | 220/254.3 |
| 2004/0159665 | A1 | 8/2004 | Morrissey et al. | |
| 2007/0068943 | A1 * | 3/2007 | Ramsey et al. | 220/254.3 |
| 2007/0164026 | A1 * | 7/2007 | Morrissey et al. | 220/254.3 |

FOREIGN PATENT DOCUMENTS

| | | | |
|---|---|---|---|
| FR | 2 936 227 | A1 | 3/2010 |
| WO | WO 2009/062004 | A1 | 5/2009 |
| WO | WO 2010/031975 | A1 | 3/2010 |

OTHER PUBLICATIONS

International Search Report for corresponding International Application No. PCT/FR2012/050036, mailed on Feb. 29, 2012, 3 pages.

* cited by examiner

*Primary Examiner* — Robert J Hicks
*Assistant Examiner* — Kareen Rush
(74) *Attorney, Agent, or Firm* — Bookoff McAndrews, PLLC

(57) ABSTRACT

The invention relates to the field of packaging for a consumable product, the packaging being provided with a wall (15) provided with an orifice (13). The packaging is fitted with an opening and closing device (1) comprising a single-piece body (2) of molded material fastened on the wall (15), the body (2) comprising a plate (20) with a first hole (30) placed facing the orifice (13) and fastened to the edge (19) of the orifice (13) in the wall (15) in sealed manner, and a hatch (40) hinged to the plate (20), the hatch opening towards the inside of the packaging and being suitable for covering the first hole (30) in a closed position, the device (1) further including an arm (50) connected to the hatch (40), the arm (50) co-operating with position blocking means for holding the hatch (40) in a closed position, and for releasing the hatch (40) to pivot towards the inside of the packaging when it is disengaged from the blocking means, the device (1) further including a cap (80) that is distinct from the body (2) and from the arm (50), and that is provided with a safety capsule (100, 104) that is to be broken on first opening of the hatch (40) such that if the safety capsule is intact, it is guaranteed that the packaging has not been opened previously, the capsule forming a portion of the blocking means. The hatch (40) is provided with a second hole (70) providing communication between the inside and the outside of the packaging, and the arm (50) is provided with a gasket (57) that shuts the second hole (70) in sealed manner when the arm (50) co-operates with the blocking means, such that in the closed position, the device (1) closes the packaging in sealed manner, the gasket (57) releasing the second hole (70) when the arm (50) is disengaged from the blocking means and the pivot angle $\beta$ of the arm relative to its closed position is greater than a strictly positive threshold angle $\beta_0$.

20 Claims, 9 Drawing Sheets

PACKAGING PROVIDED WITH A SEALED OPENING AND CLOSING DEVICE

CROSS-REFERENCE TO RELATED APPLICATIONS

This application is a National Stage filing under 35 U.S.C. §371 of International Application No. PCT/FR2012/050036, filed Jan. 5, 2012, which claims priority to French Patent Application No. FR1150150, filed Jan. 10, 2011, the contents of each of which are incorporated by reference herein.

The present invention relates to packaging for a consumable product, which packaging is provided with a wall and has an orifice.

The invention relates more particularly to a device for opening and closing such packaging.

By way of example, the packaging may be a beverage can, i.e. a container that is substantially cylindrical, usually made of double reduced steel or of aluminum, for containing a consumable product such as a liquid beverage. In the description below, the terms "inside" and "outside" designate the portions of a part respectively directed towards or situated inside the packaging, and directed towards or situated outside the packaging. As an example of packaging of the prior art and of the invention, reference is made to a beverage can. As an example of a consumable product, reference is made to a liquid beverage.

The bottom end of the can is closed and its top face comprises a lid having a plane portion that includes a capsule, and a tongue that is attached to the lid via an attachment point situated in the proximity of the capsule. By a lever movement relative to the attachment point, the tongue presses on the capsule so as to tear a precut portion of the perimeter of the capsule. On tearing, the capsule thus creates an orifice through which the liquid contained in the can can flow to the outside, e.g. in order to be consumed. The capsule is thus folded into the inside of the can, being held attached to the lid by the non-torn portion of its perimeter.

Such a can presents the drawback of not being reclosable once it has been opened. The liquid can thus escape if the can is knocked over. Foreign bodies (insects, dust) can also contaminate the liquid by penetrating through the orifice in the lid. Furthermore, if the liquid is carbonated, the beverage will go flat after a few hours. Those drawbacks thus oblige the user to consume all of the content of the can within a short period of time after it has been opened.

In order to remedy that problem, a can has been developed in which the lid is fitted with an opening and closing device (patent application WO 2010/031975), which device is described below with reference to FIGS. 16 and 17. That device 1 comprises a single-piece body 2 of molded material that comprises a plate 20 having a first hole 30 placed facing the orifice 13 in the lid 15 and fastened on the edge 19 of the orifice in sealed manner, and a hatch 40 hinged to the plate 20 and opening towards the inside of the can and suitable for covering the first hole 30 in the closed position. That device 1 also has an arm 50 connected to the hatch 40 and co-operating with means for blocking it in position so that it holds the hatch 40 in a closed position. When the arm 50 is disengaged from the blocking means (by a lever movement), the hatch 40 is released and pivots towards the inside of the can, thereby opening the first hole 30 and allowing the liquid contained in the can to flow through the orifice 13 and through the first hole 30. In FIGS. 16 and 17, the device is shown with the hatch 40 in the open position.

That device 1 also has a cap 80 that is distinct from the body 2 and from the arm 50, and that has a safety capsule 100 (drawn in transparency) that needs to be broken on first opening of the hatch 40 and that forms a portion of the blocking means. Thus, if that safety capsule is intact, it is guaranteed that the packaging has not previously been opened.

In FIGS. 16 and 17, the hatch 40 has already been opened, and the safety capsule has been removed by the arm 50 during its lever movement for opening the hatch 40.

In order to reclose the can, the arm 50 is pulled so as to bring the hatch 40 back into its initial position, and the arm 50 is locked with the blocking means so as to close the first hole 30 in sealed manner.

The can is thus kept sealed between two openings of the hatch 40 of the device. It can thus be consumed on a plurality of occasions with its content being conserved between two openings of the can. In particular, when the content is a carbonated beverage, the gas released by the beverage between two openings remains inside the can, and the carbonated nature of the beverage is preserved until the next time the can is opened, to the satisfaction of the consumer.

Nevertheless, when the beverage is strongly carbonated, the user needs to exert considerable force on the arm 50 on initial opening of the can in order to push the hatch 40 into the inside of the can, since the gas exerts an opposing pressure on the hatch. This makes initial opening of the can difficult, and that is not very practical.

Also known is US patent application 2004/0159665, which describes a device having a venting and opening mechanism comprising a hatch 8, an arm 12 that is hinged on the hatch 8 and that closes a vent orifice 9 situated in the hatch 8 by means of a gasket 15, the vent orifice 9 being released by separation from the gasket 15 as soon as the arm 12 begins to open.

The invention seeks to remedy the above-mentioned drawbacks by proposing packaging provided with a device for opening and closing that enables the packaging to be opened and reclosed at will, that is sealed in leaktight manner, and that is easily operated by the user, even on first opening.

This object is achieved by the facts that the hatch is provided with a second hole providing communication between the inside and the outside of the packaging, and that the arm is provided with a gasket that shuts the second hole in sealed manner when the arm co-operates with the blocking means, such that in the closed position, the device closes the packaging in sealed manner, the gasket releasing the second hole when the arm is disengaged from the blocking means and the pivot angle $\beta$ of the arm relative to its closed position is greater than a strictly positive threshold angle $\beta_0$.

By means of these provisions, the packaging may be opened initially without difficulty, and in particular even when it contains gas under pressure, e.g. when it contains a carbonated beverage. The gas can escape (venting) via the second hole in such a manner that the gas pressure on the hatch is reduced, thereby enabling the hatch to be tilted towards the inside of the packaging without effort. Furthermore, the fact that the venting takes place only once the arm has already pivoted through a minimum threshold angle makes it possible to avoid accidental venting as a result of the lid deforming under the effect of the pressure of the gas contained inside the packaging.

Advantageously, the blocking means also include a mechanism for snap-fastening the arm on the plate.

This reinforces closed-position locking of the arm, and hence of the opening and closing device, thereby making it possible to avoid accidental unlocking of the arm by the lid deforming under the effect of the pressure of the gas contained in the container.

Advantageously, the plate is fastened to the edge of the orifice of the wall by snap-fastening.

Thus, it is particularly easy to fit and fasten the device on the wall, and sealing is reinforced.

Advantageously, the plate bears essentially against the inside face of the wall.

Given that the hatch opens towards the inside of the packaging, any gas present inside the packaging tends to press the hatch harder against the inside face of the plate of the body of the device when the hatch is in the closed position, thereby contributing to ensuring that the packaging is leaktight, and thus preventing the gas from escaping.

The invention can be well understood and its advantages appear better on reading the following detailed description of an embodiment given by way of non-limiting example. The description refers to the accompanying drawings, in which.

Figure 1:
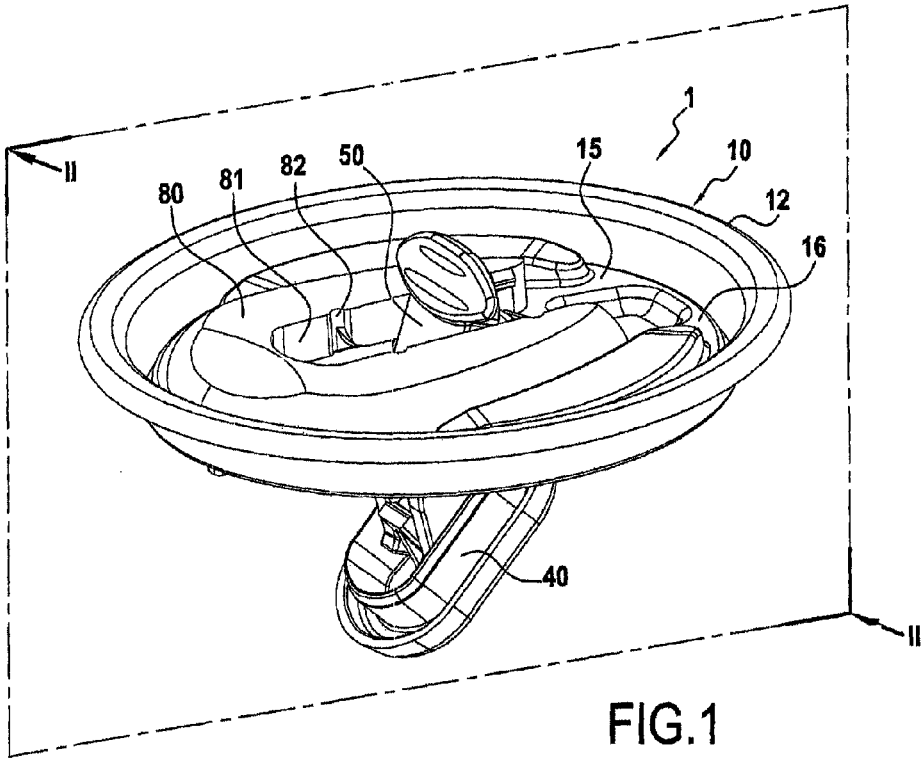
FIG. 1 is a perspective view of the lid portion of the packaging of the invention showing the opening and closing device with the hatch in the open position.

The invention is described below with reference to a beverage can. Nevertheless, any kind of packaging having a wall with an orifice may constitute the subject matter of the present invention.

FIGS. 1 to 4 show the opening and closing device 1 of the invention mounted on a lid 10 of a can (not shown). The lid 10 is substantially circular, with a substantially plane wall 15 surrounded by a peripheral rim 12. The peripheral rim 12 of the lid may for example be identical to the rim of a standard can lid, such that once provided with the device 1, the lid 10 can be mounted during fabrication on any can.

The wall 15 of the lid 10 advantageously presents at least one portion in relief 150, which is described below.

Figure 15A:
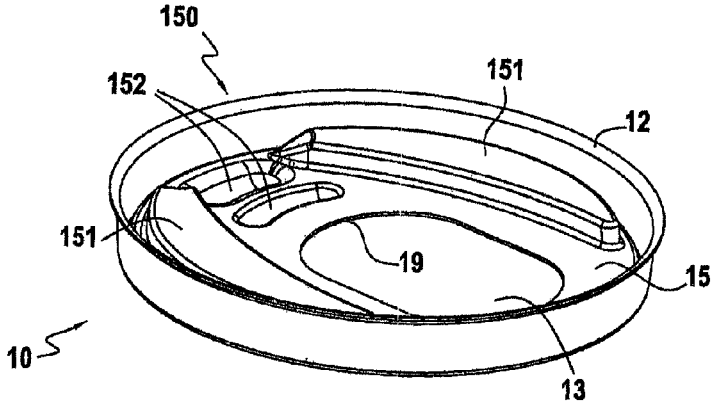
FIG. 15A is a perspective view of another embodiment of the lid of the packaging onto which the device of the invention is fastened.
Figure 15B:
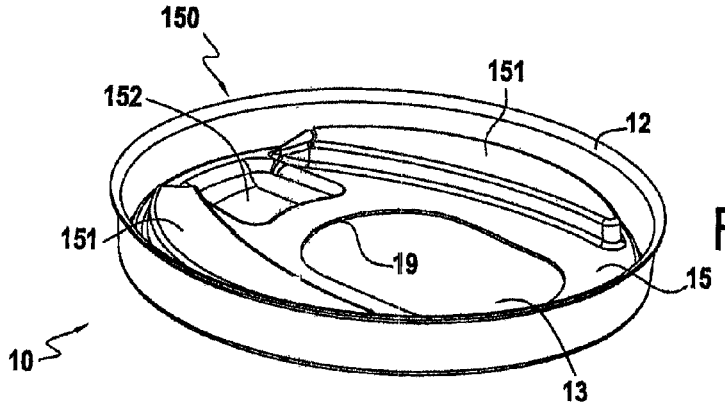
FIG. 15B is a perspective view of another embodiment of the lid of the packaging onto which the device of the invention is fastened.

The wall 15 of the lid 10 presents an orifice 13 defined by an inside edge 19 (visible in FIGS. 15A and 15B). The orifice 13 is oblong in shape and extends radially from the center of the lid 10 to the proximity of the rim 12.

Figure 2:
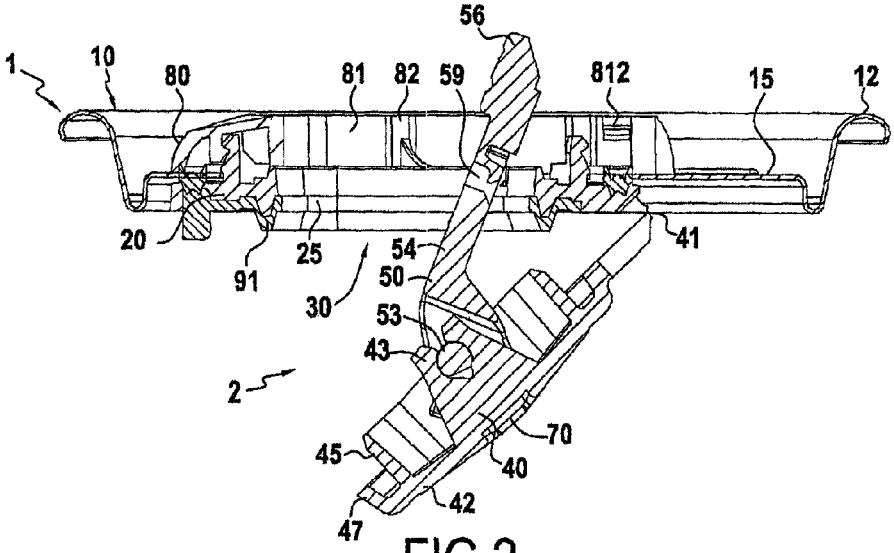
FIG. 2 is a section view of the lid and of the opening and closing device on plane II-II of FIG. 1.
Figure 3:
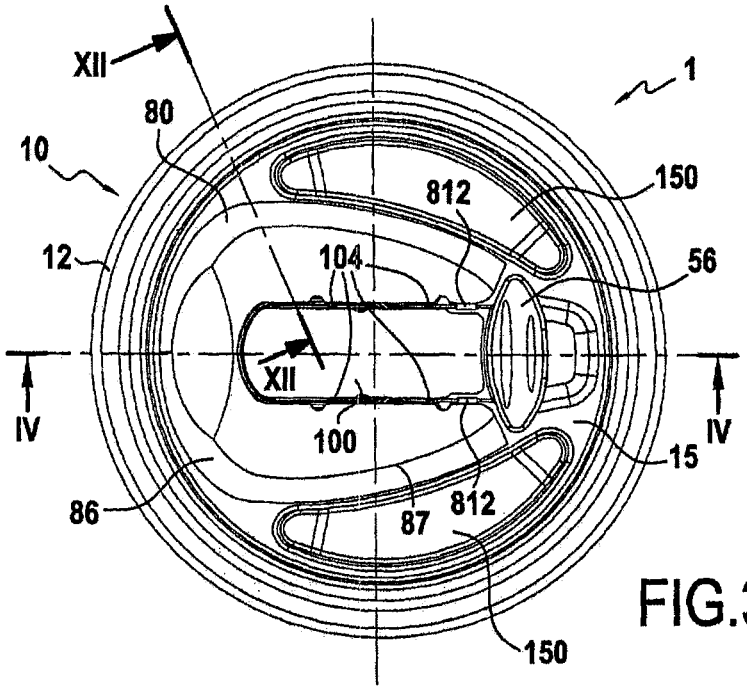
FIG. 3 is a plan view of the lid and of the opening and closing device, the hatch being in the closed position.
Figure 7:
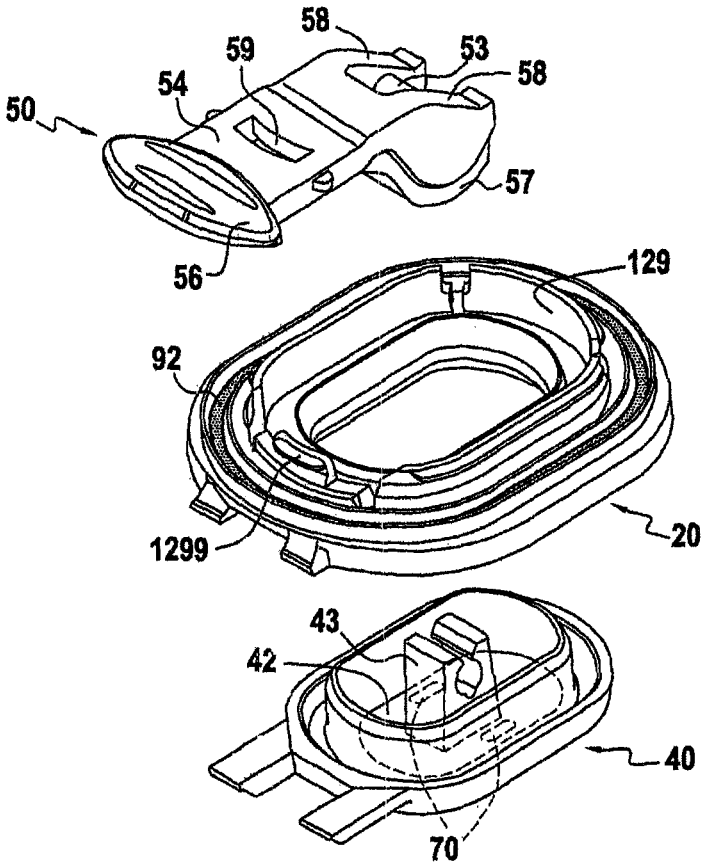
FIG. 7 is an exploded view of the arm, of the hatch, and of the plate in the closed position.
Figure 8:
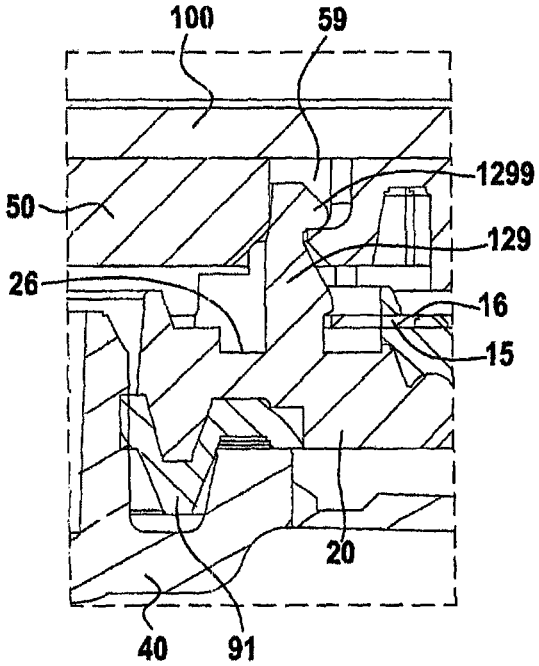
FIG. 8 is an enlarged view of the region S of FIG. 4 showing the mechanism for snap-fastening the arm on the plate.

FIGS. 1 and 2 show the device 1 in a partially open position. The device 1 comprises a body 2 that comprises a plate 20 presenting a first hole 30 in its center, which hole is defined by an edge 25 of the plate 20. The body 2 is also shown in FIGS. 7 and 8. The body 2 also has a hatch 40, the body 2 being made as a single piece, i.e. the hatch 40 and the plate 20 form a continuous unit. Thus, the body 2 is fabricated by molding a single block, which constitutes an industrial technique that is faster and less expensive than making the hatch 40 separately from the plate 20. By way of example, the body 2 is made of polymer.

The hatch 40 is hinged to the plate 20 via a flexible web 41 molded therewith and situated on the circumference of the plate 20. The web 41 thus forms a hinge. The hatch 40 has a base 42 of perimeter 47, with a cylindrical wall 45 mounted in the middle thereof. When the hatch 40 is in the open position, it is received inside the can.

Figure 4:
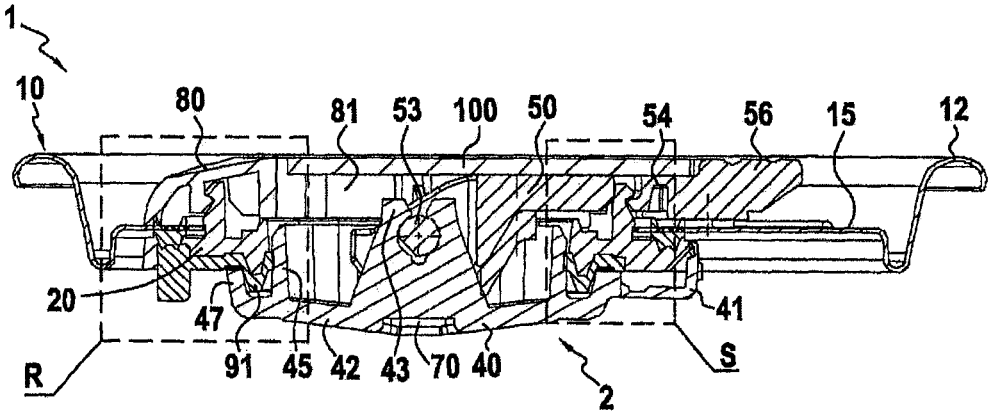
FIG. 4 is a section view of the lid and of the opening and closing device on line IV-IV of FIG. 3

FIG. 4 shows the hatch 40 in the closed position. The web 41 is then completely folded.

Around the first hole 30, the plate 20 has a first gasket 91 at the interface with the hatch 40.

This first gasket 91 extends all around the circumference of the radially inside face of the edge 25 of the plate 20 that surrounds the first hole 30, and over at least a fraction of the height of this face.

When the hatch 40 and the plate 20 are mutually engaged (with the hatch 40 closed), the radially outside face of the cylindrical wall 45 deforms the first gasket 91, thereby providing sealing between the hatch 40 and the plate 20 at the interface between the cylindrical wall 45 and the edge 25 of the plate 20.

Figure 5:
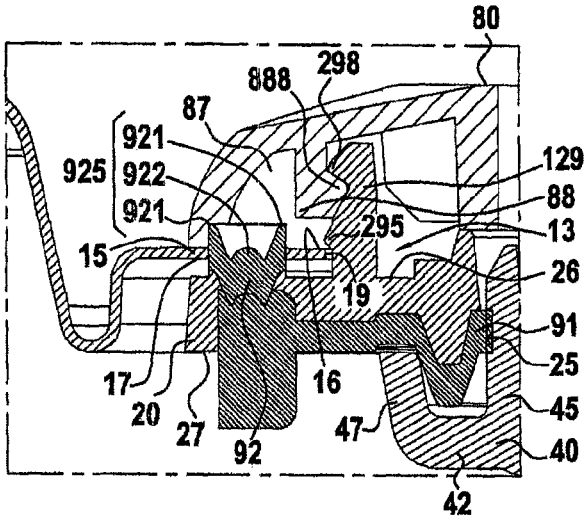
FIG. 5 is an enlarged view of the region R of FIG. 4 showing the mechanism for snap-fastening the opening and closing device on the lid.

FIG. 5 is an enlargement of a portion of FIG. 4, showing in detail the engagement of the hatch 40 and the plate 20.

The hatch 40 presents two holes, which are second holes 70. These holes establish communication between the inside and the outside of the packaging. They thus enable any gas that might be contained in the packaging to escape, even when the hatch 40 and the plate 20 are mutually engaged.

In the description below, any reference to a second hole 70 should be understood as also extending to the situation in which the second hole 70 is made up of two or more second holes 70.

In order to prevent any such escape, the arm 50 is provided with a gasket 57 that is suitable for closing the second holes 70 (see the detailed description of such a gasket 57 below). Thus, when the device of the invention is in the closed position, the first hole 30 is closed by the hatch 40, while the second holes 70 are closed by the gasket 57, such that the device closes the packaging in sealed manner.

When the device 1 is in the closed position, which implies that the hatch 40 is in the closed position, the major fraction of the perimeter 47 of the hatch 40 bears against the bottom face 27 of the plate 20 that surrounds the first hole 30 (i.e. bears against the face 27 that faces towards the inside of the can).

The hatch 40 bearing against the plate 20 in this way serves to prevent the hatch 40 from passing through the first hole 30 and serves to stabilize the interface between the cylindrical wall 45 and the first gasket 91.

Advantageously, the perimeter 47 of the hatch 40 bears against the bottom face 27 of the plate 20 over its entire length. This contact between the perimeter 47 and the bottom face 27 contributes to providing sealing at the interface between the hatch 40 and the plate 20.

Advantageously, at the location of this contact, the bottom face 27 presents a gasket against which the perimeter 47 bears when the hatch 40 is in the closed position, thereby reinforcing sealing at the location of this contact. By way of example, this gasket may be an extension of the first gasket 91, as shown in FIGS. 2, 4, and 5.

Figure 9:
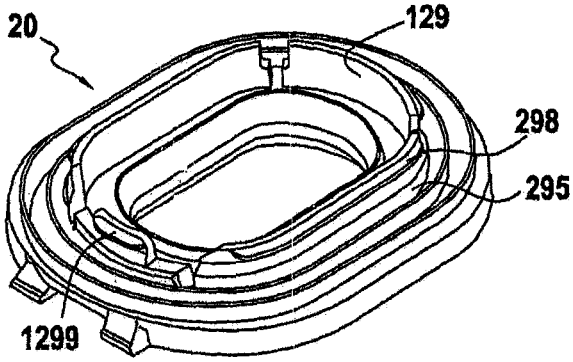
FIG. 9 is a perspective view of the body of the opening and closing device.

The fastening of the plate 20 on the lid 10 is described below with reference to FIGS. 5, 9, and 10.

A snap-fastener collar 129 extends perpendicularly from the top face 26 and extends circumferentially substantially all around the first hole 30 except on the side where the central cuff 81 of the cap 80 is open. When the plate 20 is positioned on the wall 15 of the lid 10, the collar 129 becomes inserted in the orifice 13.

On its radially outer face, the snap-fastener collar 129 has a first bead 295 that extends circumferentially all along the snap-fastener collar 129. The positioning of the snap-fastener collar 129 and the thickness in the radial direction of the first bead 295 is such that when the snap-fastener collar 129 is pushed into the orifice 13, the snap-fastener collar 129 deforms radially towards the center of the orifice 13 when the inside edge 19 of the wall 15 pushes back the first beads 295.

Thus, the plate 20 is fastened on the wall 15 of the lid 10 by snap-fastening by means of the snap-fastener collar 129.

The fact that the snap-fastener collar 129 extends over substantially the entire length of the inside edge 19 enables the plate 20 to be assembled rigidly on the lid 10.

The snap-fastener collar 129 extends beyond the first bead 295, perpendicularly to the top face 26 in the form of an extension that has a second bead 298 that extends over substantially the entire length of this extension around the first hole 30. This extension is situated a little closer to the first hole 30 than is the remainder (the base) of the snap-fastener collar 129, so as to be capable of being inserted freely in the orifice 13 (FIG. 5).

Over its entire circumference, the top face 26 includes a second groove 292 that surrounds the snap-fastener collar 129.

A second gasket 92 is housed in the second groove 292 of the top face 26 and a portion 925 of the second gasket 92 projects outside the second groove so that the portion 925 comes into contact with the inside face 17 when the plate 20 is fastened on the lid 10. The contact zone between the inside face 17 and the gasket 92 that bears against this face completely surrounds the orifice 13. Sealing is thus established between the wall 15 and the plate 20, thereby contributing to preventing the liquid contained in the can from flowing to the outside. In addition, when the content of the can is a carbonated liquid, the gas tends to press the plate 20 against the inside face 17 of the wall 15. The pressure exerted by the inside face 17 against the second gasket 92 then increases, thereby tending to improve the sealing between the plate 20 and the wall 15.

As shown in FIG. 5, the second gasket 92 is a ring having a cross-section that is substantially W-shaped. The ends of the two outer branches of the W-shape form respective outer lips 921 on either side of an inner lip 922 (inside portion of the W-shape) that is not as tall as the outer lip 921. The two outer lips 921 and the inner lip 922 constitute the portion 925 of the second gasket 92 that projects outside the groove 292.

Figure 10:
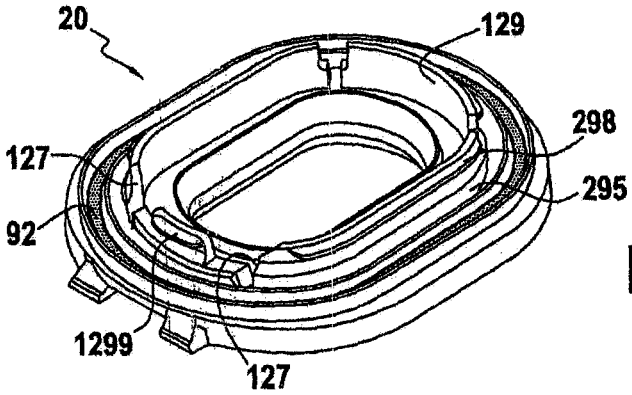
FIG. 10 is a perspective view of the body and of a gasket of the opening and closing device.
Figure 11:
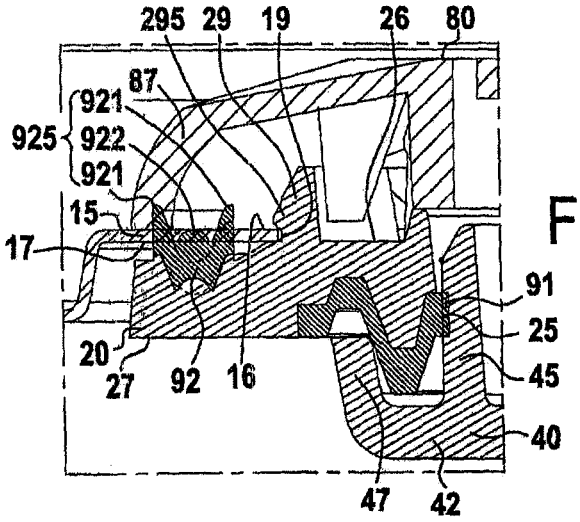
FIG. 11 is a section view of a portion of the opening and closing device in a variant of the invention, showing the mechanism for snap-fastening the body on the lid.

The second gasket 92 can also be seen in FIGS. 10 and 11.

When the plate 20 is fastened on the lid 10, the outer lips 921 stamp against the inside face 17 by moving apart from each other. During this stamping, the air situated in the central portion of the second gasket 92 in the gap between the outer lips 921 is expelled from this gap so that the second gasket 92 acts as a suction cup against the inside face 17. This suction cup effect contributes to causing the second gasket 92 to adhere more strongly against the inside wall 17, thereby reinforcing sealing between the plate 20 and the wall 15.

Furthermore, the inner lip 922 also stamps against the inside face 17, thereby further improving sealing between the plate 20 and the wall 15.

In the figures, the second gasket 92 is shown in its non-deformed condition.

An annular gasket as described above, i.e. presenting a W-shaped cross-section with two lips suitable for acting as a suction cup when the annular gasket is pressed against a plane surface, those two lips being on either side of a third lip, may also be used for providing sealing of a reclosure system different from the system of the present invention, and even not including a cap as described below.

Alternatively, the second gasket 92 may have a cross-section that is substantially V-shaped.

Advantageously, the assembly constituted by the body 2, the first gasket 91, and the second gasket 92 may be fabricated by bi-injection of a rigid polymer constituting the body 2 and a more flexible elastomer constituting the gaskets 91 and 92.

The device 1 also has an arm 50 that can be seen in FIGS. 1, 2, 3, 4, 6A, 6B, 7, and 8.

Figure 6A:
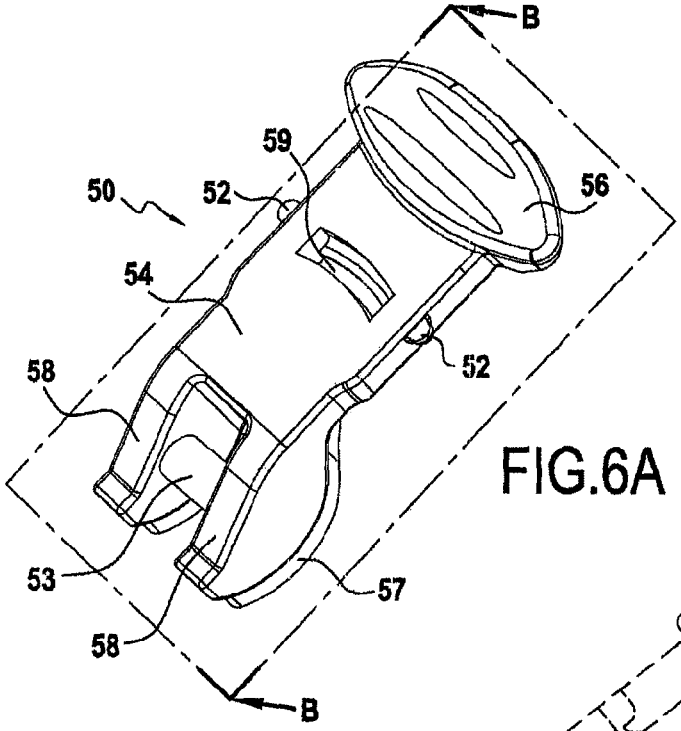
FIG. 6A is a perspective view of the arm of the opening and closing device.
Figure 6B:
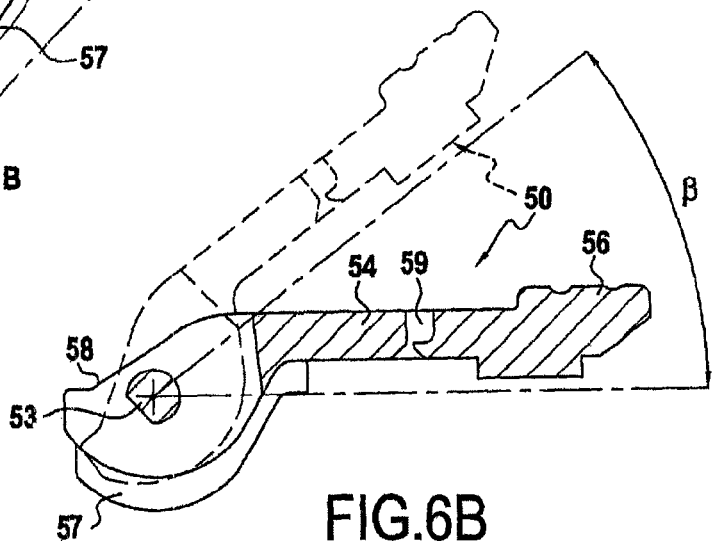
FIG. 6B is a longitudinal section view of the arm of the opening and closing device.

As shown in FIGS. 6A and 6B, the arm 50 has a bar 54 that is terminated at one end by a handle 56 and that presents a circular rod 53 at its other end. The hatch 40 (FIGS. 1, 2, and 7) includes a clamp 43 that extends perpendicularly from the base 42 of the hatch 40 and that is surrounded by the cylindrical wall 45. The rod 53 snaps into the clamp 43 so as to form a pivot hinge about an axis parallel to the pivot axis of the hinge formed by the web 41. The width of the bar 54 of the arm 50 (its dimension in the direction of this axis) is less than the width of the first hole 30 of the plate 20, such that the bar 54 can pass freely through the first hole 30.

The rod 53 is received at each of its ends in one of the two branches 58 of a fork extending the bar 54.

The fork presents a gasket 57 on its bottom face, i.e. its face that is directed towards the wall 15 of the lid 10 when the hatch 40 and the arm 50 are in the closed position. The shape of the branches 58 is such that their bottom faces describe respective portions of a cylinder centered on the axis of rotation (axis of symmetry) of the rod 53.

This gasket 57 covers the entire bottom face of each of the two branches 58 of the fork so that the gasket 57 is suitable for covering the second hole 70 in the hatch 40 when the hatch 40 and the arm 50 are in the closed position.

As shown in dashed lines in FIG. 7, the second hole 70 is in fact made up of two second holes 70, situated laterally on either side of the clamp 43. Thus, each branch 58 of the fork covers a respective one of the second holes 70.

In addition, in the closed position, the gasket 57 is pressed against the second hole 70 in effective manner since the rod 53, which is then situated above the gasket 57, is held securely in place within the clamp 43 of the hatch 40.

It can thus be understood that when the device 1 is in the closed position, i.e. when the hatch 40 closes the first hole 30 in the plate 20, and the gasket 57 of the arm 50 closes the second hole 70 in the hatch 40, then the can is closed in sealed manner.

Advantageously, the clamp 43 presents reinforcement, e.g. ribs, for the purpose of reinforcing the pivot hinge with the rod 53 and preventing the rod 53 from escaping from the clamp 43.

By way of example, the arm 50 is made of polymer, by molding, thereby minimizing its unit production cost.

Advantageously, the arm 50 is suitable for being snap-fastened directly on the plate 20 by means of a snap-fastener mechanism.

As shown in FIGS. 6 and 7, the bar 54 of the arm 50 presents a slot 59 that passes through the bar 54 along an axis perpendicular to the direction in which the bar extends (from the handle 56 to the circular rod 53) and perpendicular to the axis of rotation of the circular rod 53.

The collar 129 presents a snap-fastener projection 1299 that extends perpendicularly to the top face 26 of the plate 20. This snap-fastener projection 1299 is situated facing the slot 59 when the arm 50 is snapped onto the hatch 40 and is close to its closed position, such that when the arm 50 is pushed into the closed position, the snap-fastener projection 1299 is received and blocked in the slot 59, as shown in FIG. 8.

Alternatively, the slot 59 need not be a through slot, it could open out only into the bottom face of the arm 50, i.e. into its face that faces towards the wall 15 of the lid 10 when the hatch 40 and the arm 50 are in the closed position.

This snap-fastener mechanism contributes to holding the arm 50 and thus the hatch 40 in the closed position.

It is possible to use other mechanisms for snap-fastening the arm 50 on the plate 20.

Figure 12:
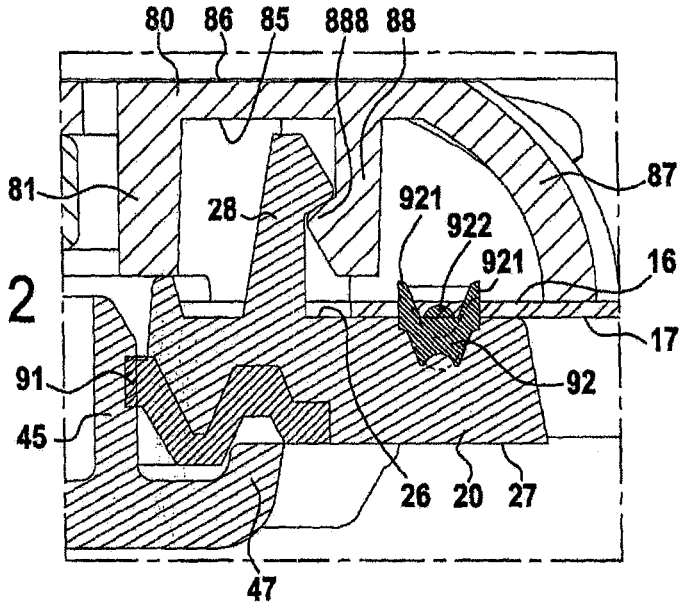
FIG. 12 is an enlarged view of a section of the device on line XII-XII of FIG. 3 in a variant of the invention, showing the mechanism for snap-fastening the cap on the plate.

The device 1 also has a cap 80 that is distinct from the body 2 and the arm 50. The cap 80 is in the form of a curved shell with a concave face 85 and a convex face 86 (FIGS. 5 and 12). The cap 80 is bordered by a rim 87 and includes tabs 88 that extend from the concave face 85 substantially perpendicularly thereto. The cap 80 is positioned on the outside face 16 of the wall 15 of the lid 10 and is assembled on the plate 20 by means of the tabs 88.

Figure 14:
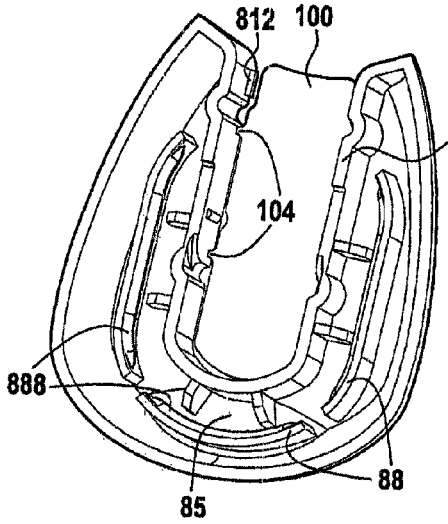
FIG. 14 is a perspective view of the cap in a variant of the invention.

On their radially inner faces, the ends of the tabs 88 present respective ribs 888 that snap-fasten with the second bead 298 when the cap 80 is fastened on the plate 20 so as to secure the cap 80 on the plate 20 (FIGS. 5 and 14).

The tabs 88 form an almost continuous collar around the central cuff 81, thereby enabling the cap 80 to be rigidly secured on the plate 20.

The cap 80 is U-shaped. The center of the cap 80 is thus a U-shaped hole that is open to one side. This hole is defined by a central cuff 81 that extends from the convex face 86 beyond the concave face 85 and substantially perpendicularly thereto. The width of the central cuff 81 is substantially equal to the width of the first hole 30 in the plate 20, and when the cap 80 and the plate 20 are assembled together, the central cuff 81 is situated substantially in alignment with the edge 25 of the first hole 30, with the exception of the side where the central cuff 81 is open. This side is the side beneath which the web 41 is situated. Thus, when the device 1 is reclosed, the arm 50 folds over a portion of the hatch 40 and of the web 41, with a fraction of the wall 15 of the lid 10 then being situated between the arm 50 and the hatch 40.

The arm 50 is suitable for folding until the top face of the arm 50 is situated in alignment with the convex face 86 of the cap 80 and fills the gap at the center of the cap 80 (as shown in FIG. 4) with the exception of the top of the U-shape. As a result, no portion of the device 1 projects above the rim 12 of the lid 10, thereby minimizing additional occupation of space compared with a prior art can.

By way of example, the cap 80 is made of polymer, by molding, thereby minimizing its unit production cost.

In a variant, the assembly by snap-fastening of the plate 20 on the lid 10 and of the cap 80 on the plate 20 may be performed in the manner described below with reference to FIGS. 11 to 13.

The snap-fastener collar 129 (as described above) is replaced by first tabs 29 and by second tabs 28.

On its top face 26, the plate 20 has first tabs 29 that are situated around the first hole 30 and that extend perpendicularly to the top face 26. The first tabs 29 are situated along a path of shape that is identical to the orifice 13 and of a size that is slightly smaller, such that when the plate 20 is positioned on the wall 15 of the lid 10, the first tabs 29 become inserted in the orifice 13.

On its radially outer face, each of the first tabs 29 has a bead 295 that extends circumferentially along the tabs 29. The positioning of the first tabs 29 and the thickness (in the radial direction) of the beads 295 is such that when these first tabs 29 are pushed into the orifice 13, the first tabs 29 deform radially towards the center of the orifice 13 when the inside edge 19 of the wall 15 pushes back the beads 295. Thus, the plate 20 is fastened on the lid 10 by snap-fastening by means of the first tabs 29.

Figure 13:
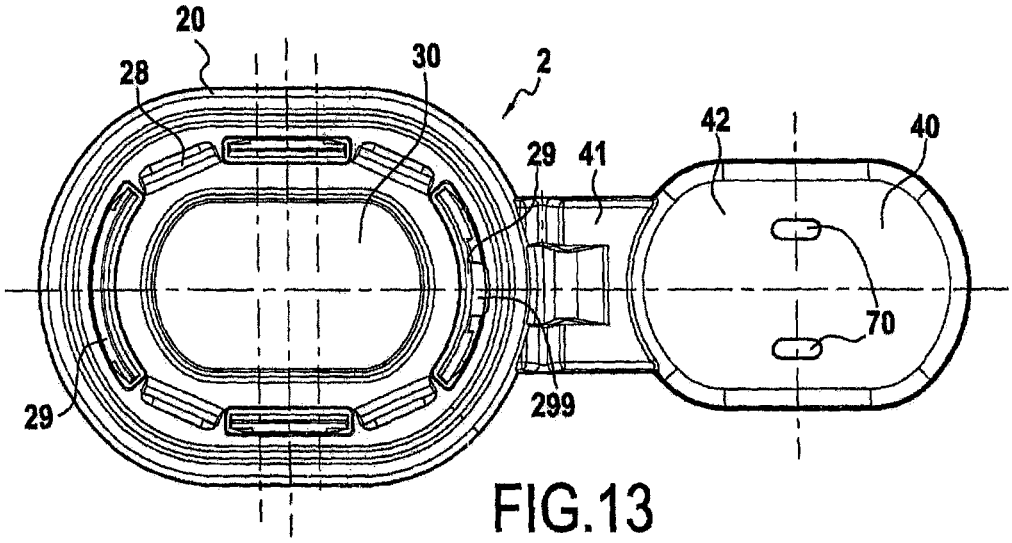
FIG. 13 is a plan view of the body of the opening and closing device.

As shown in FIG. 13, the first tabs 29 are distributed over the plate 20 around the entire circumference of the orifice 13 in such a manner that the snap-fastening is distributed substantially uniformly all around the circumference. The distance between the top face 26 (opposite from the bottom face 27) of the plate 20 and the beads 295 is equal to the thickness of the wall 15, such that after snap-fastening the top face 26 is held pressed against the bottom face 17 of the wall 15 by the beads 295.

The cap 80 has tabs 88 that extend from its concave face 85 substantially perpendicularly thereto.

These tabs 88 snap-fasten on second tabs 28 of the plate 20 that extend from the top face 26 of the plate 20 through the orifice 13. On their radially inner faces, the ends of the tabs 88 present respective ribs 888, and these ribs 888 snap-fasten with the second tabs 28 at the ends of the second tabs, which are toothed-shaped (FIG. 12).

The tabs 88 thus provide means for securing the cap 80 on the plate 20.

As shown in FIG. 7, the first tabs 29 and the second tabs 28 are distributed in alternation on the plate 20 all around the first hole 30, with this distribution of the second tabs 28 ensuring that the snap-fastening between the cap 80 and the plate 20 is distributed substantially uniformly all around the perimeter of the first hole 30.

The tabs 88 are of a height that is shorter than the height of the rim 87 such that when the tabs 88 are snap-fastened with the second tabs 28, the rim 87 bears against the top face 16 of the lid 10, thereby locking and stabilizing the assembly between the cap 80 and the body 2. Thus, a region of the wall 15 of the cap 10 that is located around the orifice 13 is sandwiched between the cap 80 and the plate 20.

Advantageously, the arm 50 is suitable for being snap-fastened directly on the plate 20 by means of snap-fastener mechanism.

As shown in FIGS. 6 and 7, the bar 54 of the arm 50 presents a slot 59 that passes through the bar 54 along an axis perpendicular to the direction in which the bar extends (from the handle 56 to the circular rod 53) and perpendicular to the axis of rotation of the circular rod 53.

One of the first tabs 29, which is situated facing the slot 59 when the arm 50 is snap-fastened on the hatch 40 so as to be close to its closed position, presents a snap-fastener projection 299 that extends perpendicularly to the top face 26 (see FIG. 13). Thus, this snap-fastener projection 299 is received in and blocked in the slot 59 when the arm 50 is folded into its closed position.

Alternatively, the slot 59 need not be a through slot, opening out solely into the bottom face of the arm 50, i.e. into its face that faces towards the wall 15 of the lid 10 when the hatch 40 and the arm 50 are in the closed position.

This snap-fastener mechanism contributes to holding the arm 50 and thus the hatch 40 in the closed position.

It is possible to use other mechanisms for snap-fastening the arm 50 on the plate 20.

The operation of opening and closing the device 1 is described below with reference to FIGS. 1, 2, 3, and 4.

Before first opening of the device 1, the arm 50 is folded as described above. The cap 80 has a tongue 100 that can be seen in FIGS. 3 and 4, which show the device 1 prior to first opening. The tongue 100 is situated substantially level with the convex face 86 of the cap 80 and it covers the bar 54 of the arm 50, leaving the handle 56 free. The tongue 100 covers the central cuff 81 in full or in part (i.e. it covers the central region of the U-shape of the cap 80). The tongue 100 is connected to the cap 80 by an attachment system. The attachment system is designed to be irreversibly broken on first opening of the device 1. The attachment system comprises four links 104 distributed around the perimeter of the tongue 100, each link establishing a bridge between the edge of the tongue 100 and the central cuff 81 from which said edge is separated by a narrow gap.

The tongue 100 and the four links 104 are made out of polymer, for example, by being molded integrally with the cap 80, thereby minimizing its unit production cost.

The tongue 100, the links 104 connecting the tongue to the cap 80, and the attachment system thus together constitute a safety capsule that, providing it is intact, guarantees that the can has not previously been opened. The safety capsule forms a part of the means for blocking the arm 50 in the shut position.

Other configurations may be envisaged for the safety capsule.

In order to open the device 1 for the first time and consume the content of the can, the arm 50 is raised by means of a handle 56, thus beginning to break the links 104 (once the arm is in its open position, all of the links 104 will be broken and the tongue 100 will be completely detached, no longer having any purpose).

By continuing to raise the arm 50, the gasket 57 is caused to slide over the second hole 70.

The gasket 57 extends along the bottom face of each of the two branches 58 and the bottom face of the arm 54 such that the gasket 57 is suitable for covering the second hole 70 from the position in which the arm 50 is in its closed position (i.e. substantially parallel to the hatch 40) as far as a position of the arm 50 in which the arm 50 has pivoted through an angle $\beta$ that is equal to a strictly positive threshold angle $\beta_0$.

For a given position of the arm 50 (arm raised), the angle $\beta$ is the angle measured about the axis of rotation of the rod 53 between the arm 50 in the closed position and the arm 50 in said given position (see FIG. 6B).

Beyond the threshold angle $\beta_0$, the arm 50 is in an open position. The gasket 57 then no longer covers the second hole 70 and any gas contained in the can can begin to escape therefrom while the hatch 40 is still shutting the first hole 30 almost completely. Thus, the pressure of the gas against the bottom face of the hatch 40 is reduced, thereby enabling the hatch 40 to be tilted towards the inside of the can using the arm 50 and with little effort.

In addition, the sliding movement of the gasket 57 of the arm 50 relative to the second hole 70 enables this hole 70 to be disengaged and also to be shut without any difficulty for the user, even when the pressure of the gas inside the can is high.

By way of example, the threshold angle $\beta_0$ is greater than 25°, thereby preventing the can from venting accidentally in the event of the arm 50 being pivoted from its closed position (by the user, or by the plate 20 and the hatch 40 being deformed).

By way of example, the threshold angle $\beta_0$ is greater than 30°.

The threshold angle $\beta_0$ is not too great so that at the beginning of venting, the tongue 100 (or more generally the safety capsule) is still partially attached to the cap 80, thereby protecting the user from possibly being sprayed by the content of the can through the second hole 70.

Thereafter, by continuing to raise the arm 50, the last links 104 are broken and the tongue 100 is removed completely.

The bar 54 of the arm 50 has two lugs 52 (visible in FIG. 6A) that project sideways from the bar 54. These lugs 52 are for being received in grooves 82 in the body 80 that extends from the convex face 86 along the central cuff 81, perpendicularly to said face. When the lugs 52 are received in the grooves 82, the handle 56 of the arm 50 comes to bear against the convex face 86 and the hatch 40 is thus blocked in its open position. The grooves 82 and the lugs 52 thus constitute means for blocking the arm 50 in the open position. It is possible to envisage other means for blocking the arm 50 in the open position.

The width (i.e. the dimension along the pivot axis of the hinge formed by the web 41) of the handle 56 of the arm 50 is greater than the width of the central cuff 81, thereby preventing the arm 50 from dropping into the inside of the can, and making it easy to close the can subsequently.

The grooves 82 are situated in such a manner that when the lugs 52 are received in the grooves 82, the arm 50 is almost perpendicular to the plate 20, thereby guaranteeing that the hatch 40 is maximally open (for example, the grooves 82 are situated in the third closest to the top of the U-shape (hole in the central cuff 81)). The flow of liquid through the cuff 81 is thus optimized.

The first hole 30 is oblong in shape, being substantially identical to the shape of the orifice 13 in the lid 10 and smaller in size. When the arm 50 is in the open position, this shape releases a sufficiently large fraction of the central cuff 81 in front of the arm 50 (the region of the top of the U-shaped central cuff 81 that is closest to the rim 12 of the lid) to enable the liquid contained in the can to flow at a rate that is appropriate for being consumed by a user.

Advantageously, the gasket 57 of the arm 50 covers the second hole 70 when the arm 50 is in the open position, thereby avoiding pollution of the second hole 70.

In order to reclose the device 1, the lugs 52 are separated from the grooves 82 and the hatch 40 is raised using the arm 50 until the hatch 40 is pressed against the bottom face 27 of the plate 20, after which the arm 50 is folded against the outside face 16 of the wall 15 of the lid 10, in the central region of the U-shape.

While the arm 50 is being folded, it pivots about the axis of symmetry of the rod 53, and the gasket 57 slides to cover the second hole(s) 70, so that both the first hole 30 and the second hole(s) 70 are shut once more in sealed manner (FIG. 4).

The cap 80 thus leaves the arm 50 disengaged. The central cuff 81 includes two catches 812 respectively on its facing faces (the two sides of the U-shape), which catches 812 project a little from the central cuff 81 and extend towards each other. These catches 812 are situated close to the convex face 86 (FIGS. 2 and 3), such that when the arm 50 is folded back as described above, or before first opening (FIGS. 3 and 4), the bar 54, which is of width that is just less than the width of the central cuff 81, lies beyond (under) the catches 812 and is snap-fastened thereby. By way of example, the catches 812 are situated as close as possible to the open end of the U-shape (above the web 41), so that the force needed for disengaging the arm 50 from the catches 812 is maximized. The hatch 40 and the arm 50 are thus blocked in the closed position by means of the catches 812 that are secured to the cap 80, thereby constituting means for blocking the arm 50 in the closed position. These blocking means are also used prior to first opening of the device 1 (see above), together with the safety capsule.

The blocking means may also include a mechanism for snap-fastening the arm 50 on the plate 20, as described above.

Alternatively, the blocking means may be situated solely on the body 2 and the arm 50, as described above (snap-fastening of the arm 50 on the plate 20).

It is possible to envisage other means for blocking the arm 50 in the closed position and secured to the cap 80.

In the main embodiment of the plate 20 and of the cap 80 as shown in FIGS. 1 to 10 and as described above, a snap-fastener collar 129 extends circumferentially around substantially all of the first hole 30, with the exception of the side where the central cuff 81 of the cap 80 is open, so as to allow the bar 54 of the arm 50 to pass when the arm 50 is folded back (device in the close position).

When the cap 80 is secured to the plate 20, the radially outer faces of the two branches of the U-shape formed by the central cuff 81 (FIG. 14) bear against the two faces 127 forming the ends of the snap-fastener collar 129 (FIG. 10). Since these end faces 127 are situated facing each other on either side of the central cuff 81 and on the outside thereof, they contribute to holding the two branches of the U-shape of the central cuff 81 in position.

Thus, when the arm 50 snap-fastens against the two catches 812 of the central cuff 81, the central cuff strongly opposes such snap-fastening since the snap-fastener collar 129 prevents the two branches of the U-shape of the central cuff 81 from splaying apart since they bear against the end faces 127.

This ensures that the device 1 of the invention is locked more effectively in the closed position.

Sealing of the device 1 in the closed position is thus guaranteed by these means for blocking the arm 50 and by the sealing means constituted by the intimate contact between the cylindrical wall 45 and the inside face of the edge 25 of the plate 20 fitted with the gasket 91, and between the gasket 57 and the second hole 70 (see above).

It is possible to envisage other configurations for the sealing means.

Advantageously, the base 42 of the hatch 40 is cup-shaped, bulging towards the inside of the packaging, and the second hole(s) 70 is/are situated in the bottom of this cup-shape (FIGS. 2 and 4).

Thus, any liquid present on the base 42 can escape via the second hole(s) 70 before the device 1 closes.

It can be understood that the device 1 of the invention enables a can to be opened and closed again and again in leaktight manner as often as desired, thereby avoiding losing the content of the can, and enabling the content to be consumed on several occasions without loss of its properties between two such occasions.

The three elements making up the device 1 (i.e. the body 2, the arm 50, and the cap 80) are assembled together merely by a succession of snap-fastening operations: the plate 20 of the body 2 is snap-fastened on the inside edge 19 of the orifice 13 in the lid 10. Thereafter, once the hatch 40 of the body 2 has been folded towards the plate 20, the arm 50 is snap-fastened onto the hatch 40 by passing the bar 54 of the arm 50 through the first hole 30 in the plate 20. Once the arm 50 has been folded against the outside face 16 of the lid 10, the cap 80 snap-fastens on the plate 20, with the arm 50 being situated in the center of the U-shape formed by the cap 80.

The device 1 is thus easy to fabricate and to assemble on a can, at very low cost.

In similar manner, the device 1 may be fabricated and assembled on a wall of any packaging in order to constitute packaging of the invention. The wall 15 may be plane or rounded.

By performing tests, the inventors have found that the sealing between the device 1 and the can is improved when the wall 15 of the lid 10 presents at least one portion in relief 150 in the vicinity of the cap 80. The force exerted on the lever 50 during closing of the device 1 produces forces on the wall 15 that tend to cause it to sag. When the wall 15 is plane without any portions in relief, then in certain configurations it can happen that sealing is broken at the interface between the wall 15 and the plate 20.

The portions in relief 150 cover a fraction of the surface of the wall 15 around the cap 80 and they are arranged symmetrically relative to the longitudinal axis A of the device 1 (i.e. the axis extending along the longitudinal direction of the arm 50).

By way of example, and as shown in FIGS. 15A and 15B, the portions in relief 150 cover substantially all of the surface of the wall 15 around the cap 80.

Advantageously, the portions in relief 150 include separate bulges 151 arranged symmetrically relative to one another on either side of the axis A, together with at least one depression 152 that is symmetrical relative to the axis A, that is intersected by said axis, and that is situated between the bulges 151. This improves the stiffness of the wall 15.

By way of example, the portions in relief 150 comprise two bulges 151 and two depressions 152, as shown in FIG. 15A. Each bulge 151 is in the form of a crescent with the convex side following the peripheral rim 12 of the lid 10 and with the concave side following the radially outer edge of the cap 80 and the handle 56 of the arm 50. Each bulge 151 extends substantially in the direction of the axis A and projects above the wall 15, i.e. in the same direction as the peripheral rim 12 (towards the outside of the can). The bulges 151 do not join together in the region around the handle 56 (the device 1 being in the closed position), such that they are separated by a gap intersected by the axis A.

In this gap, between the peripheral rim 12 and the cap 80, there are two curved oblong depressions 152 that extend vertically in the opposite direction to the bulges 151 (towards the inside of the can). One of these depressions 152 extends practically from one of the bulges 151 to the other bulge 151.

Alternatively, and as shown in FIG. 15B, the portions in relief 150 comprise two bulges 151 and one depression 152 that is substantially square in shape.

The configurations of the portions in relief 150 as shown in FIGS. 15A and 15B optimize the stiffness of the wall 15.

Advantageously, the height of each bulge 151 and the depth of each depression 152 is no more than 0.5 millimeters (mm).

Thus, and as shown by the tests performed by the inventors, the stresses generated in the lid are minimized.

Figure 15C:
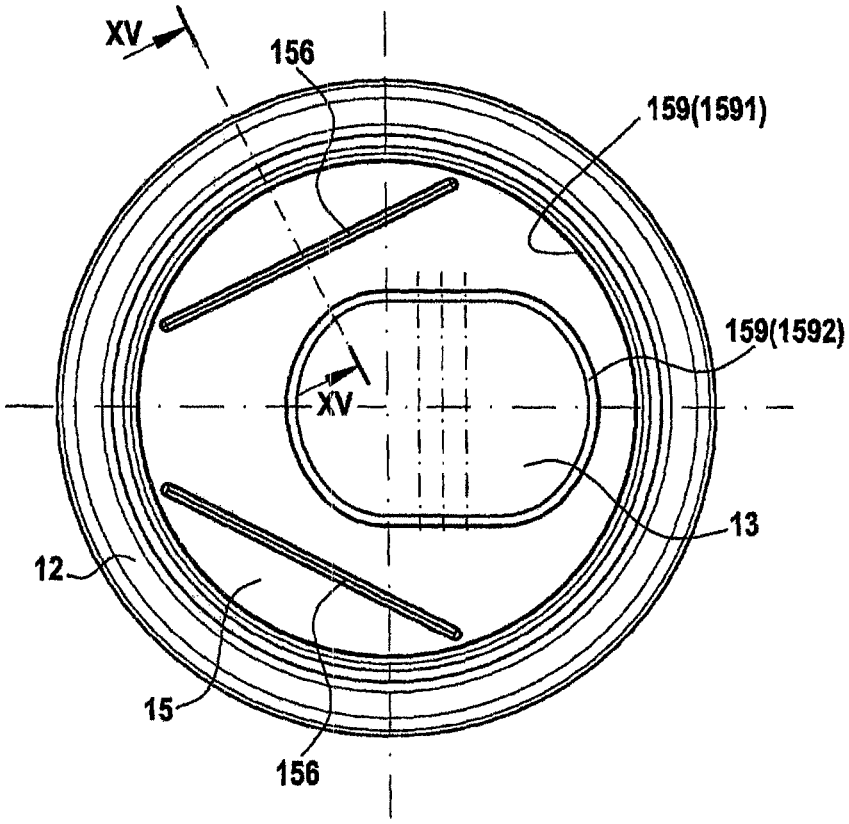
FIG. 15C is a perspective view of another embodiment of the lid of the packaging onto which the device of the invention is fastened.
Figure 15D:
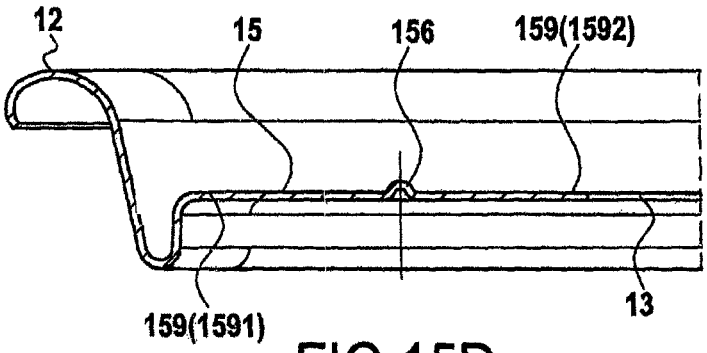
FIG. 15D is a fragmentary section on line XV-XV of FIG. 15C.
Figure 16:
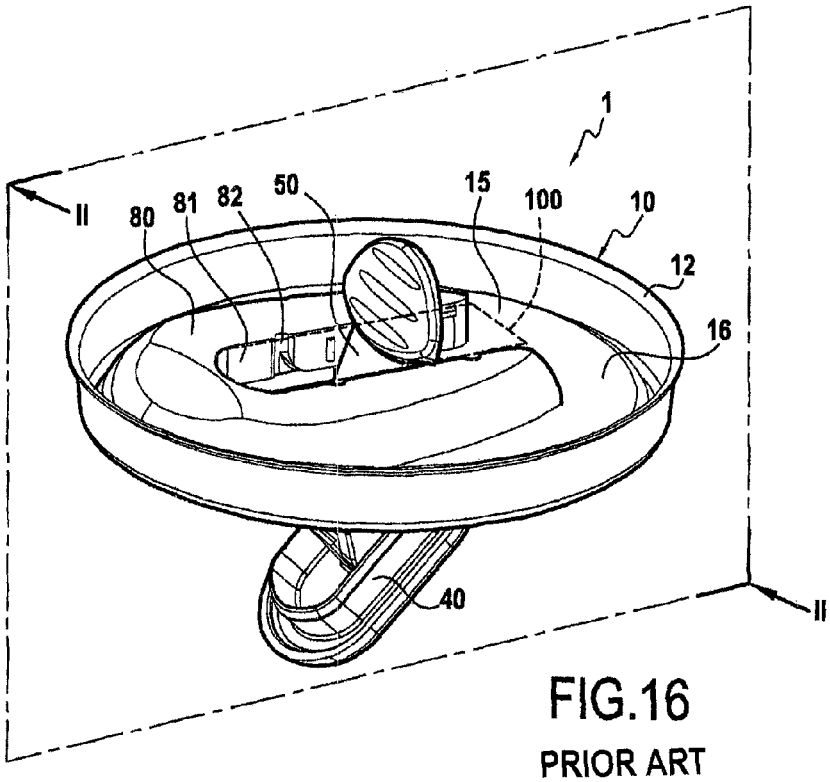
FIG.16 PRIOR ART
FIG. 16 is a perspective view of the lid portion of prior art packaging showing the opening and closing device, the hatch being in the open position.
Figure 17:
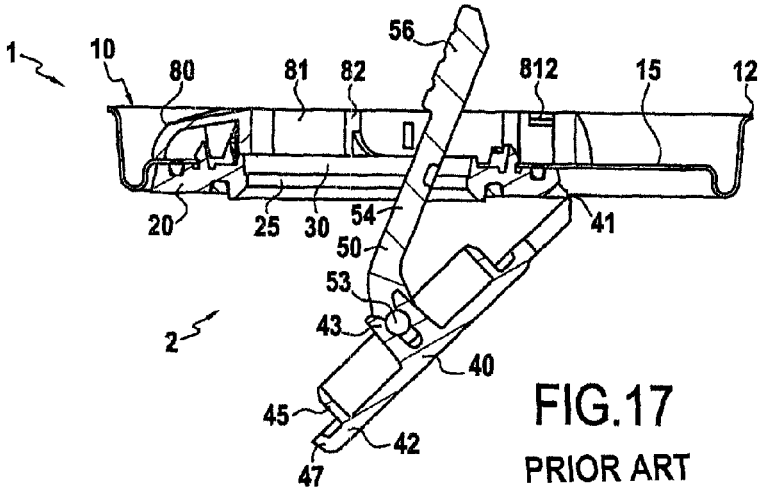
FIG.17 PRIOR ART
FIG. 17 is a section view of the lid and of the opening and closing device on plane II-II of FIG. 16.

In another configuration, as shown in FIGS. 15C and 15D, the portions in relief 150 are corrugations 156 and thinning 159.

A corrugation is a local deformation of the wall 15 out from the plane in which the wall 15 extends, but without varying the thickness of the wall. If the wall 15 is viewed in a section plane perpendicular to the direction in which the corrugation extends, then the corrugation presents the shape of a wave.

Thinning is a local reduction in the thickness of the wall 15 in its plane achieved by stamping (in the present example, the term "thinning" also covers the situation in which this local reduction in the thickness of the wall is achieved other than by stamping, e.g. by molding).

The corrugations 156 comprise two straight-line segments that are arranged symmetrically about the longitudinal axis A, each segment interconnecting two points situated close to the peripheral rim 12 of the lid.

The corrugations 156 diverge from the peripheral rim 12 so that the straight lines defined by the corrugations 156 do not intersect the orifice 13, which is thus situated between those straight lines.

The corrugations 156 do not extend in the region of the lid 10 that is covered by the cap 80.

The thinning 159 comprises first thinning 1591 running along the peripheral rim 12, which is therefore circular in this example, and second thinning 1592 on the edge of the orifice 13.

FIG. 15D is a section of the lid 10 shown in FIG. 15C going from the orifice 13 to the peripheral rim 12 and it shows one of the corrugations 156 and both kinds of thinning 159.

Tests performed by the inventors show that the stiffness of the wall 15 is optimized when the portions in relief are corrugations 156 and thinning 159 as described above and shown in FIGS. 15C and 15D.

One or more other corrugations in the wall 15 may be envisaged, instead of or in addition to the corrugations 156.

For example, the wall 15 may present a circular corrugation running along the peripheral rim 12.

The wall 15 may also present an oblong corrugation that consists in an oblong curve surrounding the orifice 13 at least in part and extending at a substantially constant distance $d_0$ therefrom. By way of example, this distance may be about 5 mm. The oblong corrugation also surrounds the cap 80 at least in part and it does not extend into the region of the lid 10 that is covered by the cap 80.

If the distance $d_0$ is less than the minimum distance between the orifice 13 and the peripheral rim 12, then the oblong corrugation surrounds the orifice 13 completely. Alternatively, the oblong corrugation surrounds the orifice 13 with the exception of the end of the orifice 13 that is closest to the peripheral rim 12 (i.e. this oblong corrugation begins at a first point close to the peripheral rim 12, surrounds the orifice 13 over a major fraction of its periphery, and extends to a second point close to the rim 12, these first and second points being symmetrical about the longitudinal axis A).

The oblong corrugation does not intersect the corrugations 156, if such corrugations 156 are present. In general, regardless of the packaging, sealing between the device 1 of the invention and the wall 15 of the packaging on which the device 1 is fastened is improved when the wall 15 includes at least one portion in relief 150 in the vicinity of the cap 80 of the device 1. The stiffness of the wall 15 in correspondence with the device 1 is thus increased.

The invention claimed is:

1. Packaging for a consumable product, the packaging being provided with a wall having an orifice that is fitted with an opening and closing device comprising a single-piece body of molded material fastened on said wall, said body comprising a plate with a first hole placed facing said orifice and fastened to an edge of said orifice in the wall in sealed manner, and a hatch hinged to said plate, the hatch opening towards the inside of the packaging and being suitable for covering the first hole in a closed position, said device further including an arm connected to said hatch, said arm co-operating with position-blocking means for holding said hatch in a closed position, and for releasing said hatch to pivot towards the inside of said packaging when it is disengaged from said blocking means, said device further including a cap that is distinct from said body and from said arm, and that is provided with a safety capsule that is to be broken on first opening of said hatch such that if said safety capsule is intact, it is guaranteed that the packaging has not been opened previously, said capsule forming a portion of said blocking means, wherein said hatch is provided with a second hole providing communication between the inside and the outside of said packaging, and in that said arm is provided with a gasket that shuts said second hole in sealed manner when said arm co-operates with said blocking means, such that in the closed position, said device closes said packaging in sealed manner, said gasket releasing said second hole when said arm is disengaged from said blocking means and the pivot angle ($\beta$) of said arm relative to its closed position is greater than a strictly positive threshold angle ($\beta_0$).

2. Packaging according to claim 1, wherein said plate is fastened to the edge of said orifice of the wall by snap-fastening.

3. Packaging according to claim 2, wherein said plate includes first tabs or a snap-fastener collar that snap-fastens onto the edge of said orifice in the wall.

4. Packaging according to claim 1, wherein said plate bears essentially against the inside face of said wall.

5. Packaging according to claim 4, wherein said plate includes a first gasket around said first hole at the interface with said hatch.

6. Packaging according to claim 4, wherein said plate includes a second gasket against which said inside face comes to bear in such a manner that a sealed junction between said wall and said plate is formed.

7. Packaging according to claim 6, wherein said second gasket is a ring-shaped gasket having two outer lips suitable for acting as a suction cup against said inside face and located on either side of an inner lip.

8. Packaging according to claim 4, wherein said cap includes means for securing it with said plate, said cap, when secured with said plate, being situated at the outside of said packaging such that a region of said wall is sandwiched between said cap and said plate.

9. Packaging according to claim 8, wherein the securing means are tabs that extend from said cap and that are suitable for snap-fastening with second tabs of the plate by means of teeth situated at the ends of said tabs and of said second tabs.

10. Packaging according to claim 3, wherein the securing means are tabs that extend from said cap and that are suitable for snap-fastening with said snap-fastener collar by means of ribs situated at the ends of said tabs and by means of a second bead situated at the end of said snap-fastener collar, said snap-fastener collar also including first beads for snap-fastening with said wall.

11. Packaging according to claim 1, wherein said means for blocking said arm in a position in which said hatch is in its closed position include means secured to said cap.

12. Packaging according to claim 11, wherein said blocking means further comprise catches secured to said cap and enabling said arm and said hatch to be pushed back into the closed position.

13. Packaging according to claim 11, wherein said blocking means further comprise a mechanism for snap-fastening said arm on said plate.

14. Packaging according to claim 1, wherein said cap is U-shaped and comprises a central region, and said arm, when in a closed position, is folded against the wall in the central region of said U-shape.

15. Packaging according to claim 14, wherein said safety capsule is made up of a tongue completely covering the U-shaped central region of said cap, together with links connecting said tongue to said cap.

16. Packaging according to claim 1, wherein it includes means for blocking said arm in a position in which said hatch is in an open position.

17. Packaging according to claim 1, wherein said hatch and said plate are hinged together by a flexible web integrally molded therewith and forming a hinge.

18. Packaging according to claim 1, wherein said wall presents at least one portion in relief in the vicinity of said cap.

19. Packaging according to claim 1, wherein the threshold angle ($\beta_0$) is greater than 25°.

20. Packaging according to claim 1, wherein said hatch presents a base that is cup-shaped and comprises a bottom, bulging towards the inside of said packaging, and said second hole is situated in the bottom of said cup-shape.

* * * * *